US010920796B2

(12) United States Patent
Todsen et al.

(10) Patent No.: US 10,920,796 B2
(45) Date of Patent: Feb. 16, 2021

(54) HYDRAULIC PRESSURE INTENSIFIER

(71) Applicant: PistonPower ApS, Soenderborg (DK)

(72) Inventors: Jorgen P. Todsen, Nordborg (DK); Jorgen Mads Clausen, Soenderborg (DK); Tom Tychsen, Graasten (DK)

(73) Assignee: PistonPower ApS, Soenderborg (DK)

( * ) Notice: Subject to any disclaimer, the term of this patent is extended or adjusted under 35 U.S.C. 154(b) by 245 days.

(21) Appl. No.: 15/909,076

(22) Filed: Mar. 1, 2018

(65) Prior Publication Data

US 2018/0252241 A1 Sep. 6, 2018

(30) Foreign Application Priority Data

Mar. 3, 2017 (EP) ..... 17159046

(51) Int. Cl.

| | |
|---|---|
| ***F15B 3/00*** | (2006.01) |
| ***F15B 15/20*** | (2006.01) |
| ***F04B 9/105*** | (2006.01) |
| ***F04B 7/02*** | (2006.01) |
| ***F04B 9/113*** | (2006.01) |

(52) U.S. Cl.

CPC ..... *F15B 3/00* (2013.01); *F04B 7/0225* (2013.01); *F04B 9/1056* (2013.01); *F04B 9/113* (2013.01); *F15B 15/202* (2013.01); *F04B 2201/0808* (2013.01); *F04B 2205/065* (2013.01); *F04B 2205/16* (2013.01); *F15B 2215/30* (2013.01)

(58) Field of Classification Search

CPC ..... F15B 3/00; F15B 15/202; F15B 2215/30; F04B 7/0225; F04B 9/1056; F04B 9/113; F04B 2205/065; F04B 2205/16; F04B 2201/0808; F04B 9/08; F04B 9/1172; F04B 9/105; F04B 53/10; F04B 49/002

USPC ..... 417/403, 399

See application file for complete search history.

(56) References Cited

U.S. PATENT DOCUMENTS 2,296,647 A * 9/1942 McCormick ..... F15B 3/00 91/306
2,508,298 A * 5/1950 Saari ..... F04B 9/1172 417/225
2,991,130 A 7/1961 Sampietro
(Continued)

FOREIGN PATENT DOCUMENTS

CN 203348188 U 12/2013
CN 103511382 A 1/2014
(Continued)

OTHER PUBLICATIONS

First Examination Report for Indian Serial No. 201814004324 dated Feb. 28, 2020.

*Primary Examiner* — Essama Omgba
*Assistant Examiner* — Christopher J Brunjes
(74) *Attorney, Agent, or Firm* — McCormick, Paulding & Huber PLLC

(57) ABSTRACT

A hydraulic pressure intensifier (1) is described comprising a housing (2) having a low pressure chamber (3) and a high pressure chamber (4), force transmitting means (5) between the low pressure chamber (3) and the high pressure chamber (4), and a switching valve (8) connecting the low pressure chamber (3) to a first pressure or to a second pressure different from the first pressure. It is intended to have a large volume on the high pressure side of the pressure intensifier. To this end the switching valve (8) is controlled by a pilot valve 18.

21 Claims, 2 Drawing Sheets

(56) References Cited

U.S. PATENT DOCUMENTS

| | | | | |
|---|---|---|---|---|
| 3,037,488 | A | 6/1962 | Barrett | |
| 3,079,864 | A | 3/1963 | Drutchas et al. | |
| 3,081,706 | A | 3/1963 | Drutchas et al. | |
| 3,241,463 | A | 3/1966 | Barrett | |
| 3,391,538 | A | 7/1968 | Orloff et al. | |
| 3,579,985 | A | 5/1971 | Barrett | |
| 3,583,832 | A | 6/1971 | Lee, II | |
| 3,632,230 | A | 1/1972 | Ueda | |
| 3,835,752 | A | 9/1974 | D'Amata | |
| 4,281,587 | A * | 8/1981 | Garcia-Crespo | B25D 9/12 91/290 |
| 4,523,895 | A * | 6/1985 | Silva | F04B 9/115 417/225 |
| 4,627,794 | A | 12/1986 | Silva | |
| 4,659,294 | A | 4/1987 | Barthomeuf | |
| 4,780,064 | A | 10/1988 | Olsen | |
| 6,497,558 | B1 | 12/2002 | Hale | |
| 6,619,243 | B2 | 9/2003 | Al-Hawaj | |
| 6,866,485 | B2 | 3/2005 | Hansen et al. | |
| 7,726,950 | B2 | 6/2010 | Hansen et al. | |
| 8,613,602 | B2 * | 12/2013 | Iversen | F15B 3/00 417/225 |
| 2003/0097924 | A1 * | 5/2003 | Hansen | F04B 9/107 91/299 |
| 2003/0099556 | A1 * | 5/2003 | Hansen | F04B 9/113 417/397 |
| 2003/0172652 | A1 | 9/2003 | Tohru | |
| 2004/0006983 | A1 * | 1/2004 | Sawdon | B23Q 1/68 60/563 |
| 2004/0115070 | A1 * | 6/2004 | Baatrup | F04B 9/107 417/403 |
| 2005/0013716 | A1 * | 1/2005 | Magami | F04B 9/1095 417/555.1 |
| 2005/0123416 | A1 * | 6/2005 | Smith | F03C 1/007 417/375 |
| 2006/0073037 | A1 | 4/2006 | Pedersen et al. | |
| 2009/0317267 | A1 * | 12/2009 | Gill | F15B 3/00 417/53 |
| 2014/0373524 | A1 * | 12/2014 | Schuller | F16H 57/0413 60/429 |
| 2016/0053749 | A1 | 2/2016 | Hunter | |
| 2018/0252206 | A1 | 9/2018 | Krissak et al. | |
| 2018/0252240 | A1 | 9/2018 | Vokel et al. | |
| 2018/0252242 | A1 * | 9/2018 | Hanusovksy | F15B 3/00 |

FOREIGN PATENT DOCUMENTS

| | | | |
|---|---|---|---|
| CN | 203757349 | U | 8/2014 |
| DE | 3032430 | A1 | 3/1982 |
| DE | 102007031166 | A1 | 1/2009 |
| EP | 0692072 | B1 | 9/1999 |
| JP | S6224001 | A | 2/1987 |
| JP | S63243464 | A | 10/1988 |
| RU | 2056550 | C1 | 3/1996 |
| RU | 19404 | U1 | 8/2001 |
| RU | 24520 | U1 | 8/2002 |
| RU | 2513060 | C1 | 4/2014 |
| SU | 638751 | A1 | 12/1978 |
| SU | 1165818 | A1 | 7/1985 |

* cited by examiner

HYDRAULIC PRESSURE INTENSIFIER

CROSS-REFERENCE TO RELATED APPLICATION

This application claims foreign priority benefits under U.S.C. § 119 to European Patent Application No. 17159046.6 filed on Mar. 3, 2017, the content of which is hereby incorporated by reference in its entirety.

TECHNICAL FIELD

The present invention relates to a hydraulic pressure intensifier comprising a housing having a low pressure chamber and a high pressure chamber, force transmitting means between the low pressure chamber and the high pressure chamber, and a switching valve connecting the low pressure chamber to a first pressure or to a second pressure different from the first pressure.

BACKGROUND

Such a pressure intensifier is known, for example, from U.S. Pat. No. 6,866,485 B2.

The force transmitting means can be, for example, in the form of a stepped piston having a larger low pressure area in the low pressure chamber and a smaller high pressure area in the high pressure chamber. When the low pressure area is loaded with a supply pressure, the piston is shifted in a direction to decrease the volume of the high pressure chamber. The pressure in the high pressure chamber is increased and the fluid with the increased pressure is outputted. In the second half of the cycle the low pressure in the low pressure chamber is lowered so that the supply pressure which is guided into the high pressure chamber can push the piston back to its initial position. The change of the pressure in the low pressure chamber is performed by means of the switching valve. Such a cycle is repeated. In each cycle a certain amount of fluid under high pressure can be outputted from the high pressure chamber.

SUMMARY

The object underlying the invention is to have a large volume output on the high pressure side of the pressure intensifier.

This object is solved with a hydraulic pressure intensifier as described at the outset in that the switching valve is controlled by a pilot valve.

When the switching valve is controlled by a pilot valve, the switching valve can be made larger. A larger switching valve allows for a larger volume flow into and out of the low pressure chamber. Thus, the time for filling and emptying the low pressure chamber is decreased and the frequency of the pressure intensifier can be increased. The pilot valve can be made very small and thereby very small hydraulic losses are created.

In an embodiment of the invention the switching valve comprises a valve element having a first control pressure area and a second control pressure area, wherein the pilot valve controls a pressure difference between the first control pressure area and the second control pressure area. The control of a pressure difference is a very simple operation. In this case the pilot valve can have a very simple construction.

In an embodiment of the invention the valve element is located in the low pressure chamber. There is no further channel between the switching valve and the low pressure chamber. Hydraulic losses can be kept small.

In an embodiment of the invention the valve element comprises an outer diameter corresponding to an outer diameter of a low pressure portion of the force transmitting means. This makes the construction of the housing simple. The space accommodating the valve element and the low pressure chamber can be machined in a single operation.

In an embodiment of the invention the valve element comprises a flange extending radially, wherein the control pressure areas are located on opposite faces of the flange. The pressure areas are kept outside of the low pressure chamber.

In an embodiment of the invention the housing comprises control channels for supplying pilot pressure to the control pressure areas and supply channels for supplying pressure to the low pressure chamber, wherein the control channels have a smaller cross sectional area than the supply channels. There is not so much hydraulic fluid necessary to change the switching position of the valve element. Therefore, the control channels can be kept small. However, when the supply channels have a larger cross section, the flow resistance in such supply channels is low and the filling and emptying of the low pressure chamber can be performed in a short time.

In an embodiment of the invention the pressures acting on the control pressure areas are switched by the pilot valve between the first pressure and the second pressure. Basically, only two pressures are necessary on the low pressure side of the pressure intensifier. These pressures can be, for example, supply pressure and tank pressure.

In an embodiment of the invention the pilot valve is controlled by the force transmitting means. Depending on the position of the force transmitting means the pilot valve generates a pressure difference in one or in another direction.

In an embodiment of the invention the pilot valve is pressure controlled. The pressure can, in turn, be controlled by the position of the force transmitting means.

In an alternative embodiment of the invention the pilot valve is electrically controlled. The pilot valve can comprise, for example, a solenoid which drives a pilot valve element of the pilot valve.

In an embodiment of the invention the pilot valve is connected to a controller, wherein the controller comprises a counter counting strokes of the pilot valve and/or of the switching valve. When, for example, the volume of hydraulic fluid under high pressure delivered for each stroke is known, then it is possible to exactly determine the amount of fluid which should be outputted. It is, however, also possible to use a counter for the strokes of the force transmitting means without a pilot valve. In this case it is possible to use sensors to determine the stroke of the force transmitting mean or to use sensors to determine the numbers of switching of the switching valve.

In an embodiment of the invention a pressure intensifier is part of a piston-cylinder-arrangement. When, for example, two piston-cylinder-arrangements are used in connection with some kind of load which is controlled by a number of such arrangements with integrated intensifiers, it is possible to keep the load horizontal. This can be done without any form of feedback from a positioning sensor of the load or something similar.

BRIEF DESCRIPTION OF THE DRAWINGS

Embodiments of the invention will now be described in more detail with reference to the drawing, wherein.

DETAILED DESCRIPTION

Figure 1:
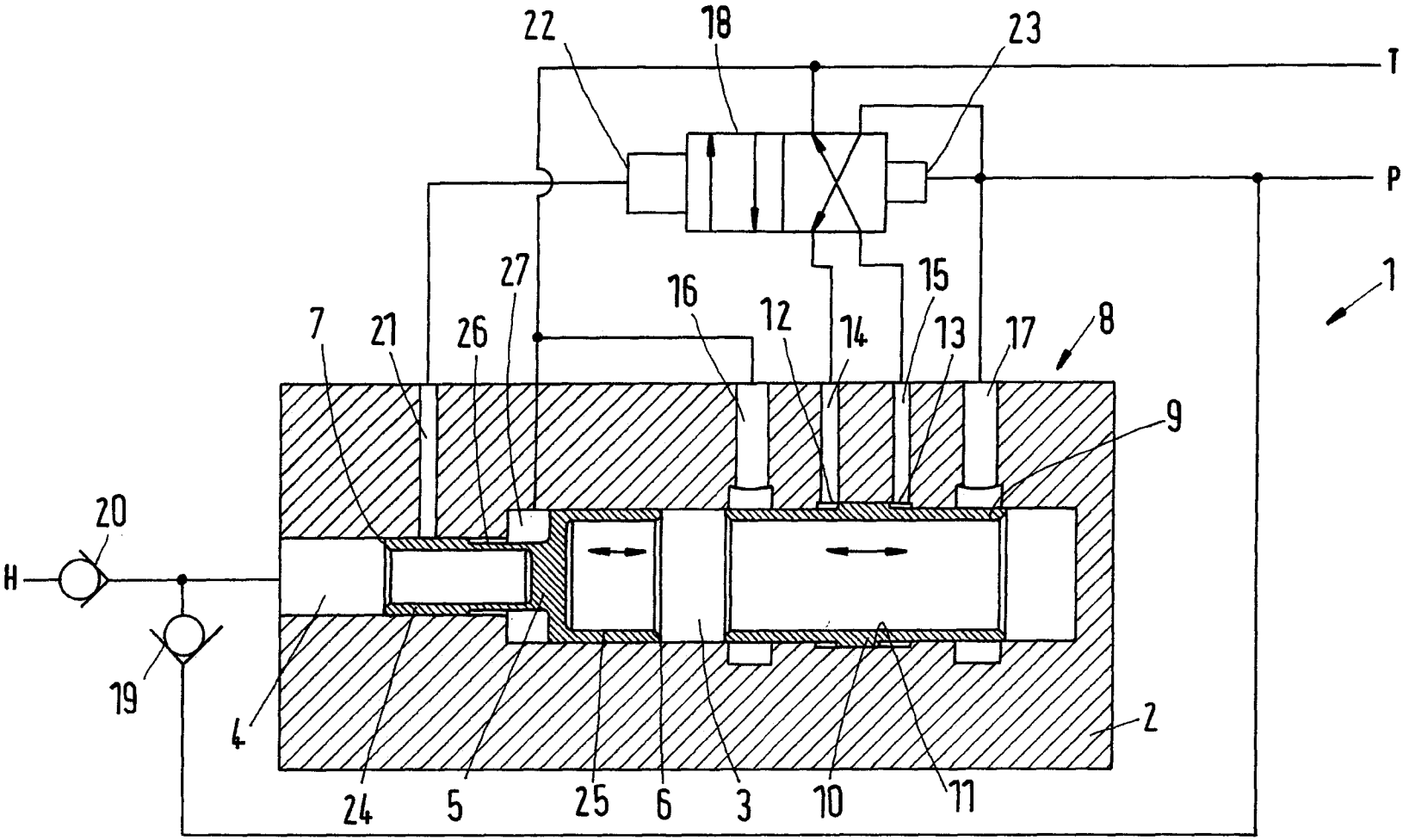
FIG. 1 is a schematic view of a pressure intensifier.

A hydraulic pressure intensifier 1 comprises a housing 2 having a low pressure chamber 3 and a high pressure chamber 4. Force transmitting means in form of a stepped piston 5 are located between the low pressure chamber 3 and the high pressure chamber 4. A piston 5 comprises a low pressure area 6 in the low pressure chamber 3 and a high pressure area 7 in the high pressure chamber 4.

A switching valve 8 comprises a valve element 9 which is located in the low pressure chamber 3. The valve element 9 comprises a radially extending flange 10 which extends into a groove 11 of the housing 2. The groove 11 has a slightly larger inner diameter than the low pressure chamber 3.

The flange 10 forms a first control pressure area 12 and a second control pressure area 13. The first control pressure area 12 receives hydraulic fluid from a first control channel 14 in the housing and the second control pressure area 13 receives hydraulic fluid under pressure from a second control channel 15 in the housing.

The valve element 9 is shown in a "neutral" position.

In a first end position, when the valve element 9 is shifted to the right, i.e. away from the piston 5, it opens an opening of a first supply channel 16 in the housing. In the opposite end position it opens an opening of a second supply channel 17 in the housing 2.

The pressure intensifier 1 has a supply pressure port P and a tank pressure port T.

Pressures in the control channels 14, 15 are controlled by a pilot valve 18. In a first position of the pilot valve 18 (shown in FIG. 1) the supply pressure port P is connected to the first control channel 14 and the second control channel 15 is connected to the tank port T. In a second position of the pilot valve 18 the second control channel 15 is connected to the supply pressure port P and the first control channel 14 is connected to the tank port T.

The first supply channel 16 is permanently connected to the tank port T and the second supply channel 17 is permanently connected to the supply pressure port P.

Furthermore, the supply pressure port P is connected to the high pressure chamber 4 via a first check valve 19 opening in a direction towards the high pressure chamber 4. The high pressure chamber 4 is connected to a high pressure output H via a second check valve 20 opening in a direction towards the high pressure output H.

Furthermore, a switching channel 21 opens into the high pressure chamber 4. This switching channel 21 is connected to a first pressure area 22 of the pilot valve 18. The pilot valve 18 comprises furthermore a second pressure area 23 which is permanently connected to the supply pressure port P. However, the first pressure area 22 is larger than the second pressure area 23.

The piston 5 comprises a high pressure portion 24 and a low pressure portion 25. A longitudinal groove 26 is provided on the high pressure portion 24 at a predetermined distance away from the high pressure area 7. This groove 26 is connected to an intermediate space 27 which is permanently connected to the tank port T. The intermediate space 27 is increased when the piston 5 moves in a direction towards the valve element 9 and is decreased when piston 5 moves in the opposite direction. At the end of a movement in this direction the longitudinal groove 26 comes in overlapping relation with the switching channel 21 and connects the switching channel 21 to the intermediate space 27.

Operations of the pressure intensifier according to the embodiments shown in FIG. 1 can be described as follows:

In the shown position of the pilot valve 18 the first control pressure area 12 of the valve element 9 is supplied with supply pressure from the supply pressure port P. The second control pressure area 13 is subjected to the pressure at the tank port T. Consequently, a pressure difference between the two control pressure areas 12, 13 is created shifting the valve element 9 in a direction away from the piston 5. This movement opens the first supply channel 16 so that pressure in the low pressure chamber 3 is equal to the pressure at the tank port T. The piston 5 is shifted in a direction towards the valve element 9 since it is loaded by the pressure in the high pressure chamber 4 which is at this point equal to the pressure at the supply pressure port P.

As soon as the high pressure portion 24 of the piston 5 opens the switching channel 21 the supply pressure from the supply pressure port P reaches the first pressure area 22 of the pilot valve 18. Since the first pressure area 22 is larger than the second pressure area 23 on which the same pressure acts the position of the pilot valve 18 is changed. Now the second control pressure area 13 is loaded by the supply pressure of the supply pressure port P and the first control pressure area 12 is connected to the tank port T. A pressure difference exists between the two control pressure areas 12, 13 shifting the valve element 9 of the switching valve 8 in a direction towards the piston 5. This movement closes the first supply channel 16 and opens the second supply channel 17. Since the second supply channel 17 is connected to the supply pressure port P the supply pressure reaches the low pressure chamber 3. Since the supply pressure in the low pressure chamber 3 acts on a low pressure area 6 which is larger than the high pressure area 7 in the high pressure chamber 4, the piston is moved to the left, i.e. away from the valve element 9. This movement is the "working stroke" in which hydraulic fluid under high pressure is outputted to the high pressure output H.

At the end of this working stroke the longitudinal groove 26 comes in overlapping relation with the switching channel 21 and connects the switching channel 21 via the intermediate space 27 to the tank port T. Consequently, the pressure at the first pressure area 22 of the pilot valve 18 is lowered to the pressure at the tank port T and the pilot valve 18 is again switched in the position shown in FIG. 1. The working cycle can start again.

The supply channels 16, 17 can have a much larger area than the control channels 12, 13 and consequently a much lower flow resistance. Furthermore, the switching valve 8 can be made rather large so that the low pressure chamber 3 can be filled with hydraulic fluid from the supply pressure port P in a rather short time. The same is true for the removal of hydraulic fluid via the first supply channel 16. Therefore, it is possible to increase the frequency of the pressure intensifier 1.

The pilot valve 18 can be made very small and thereby very small hydraulic losses are created. The pilot valve 18 can be driven with very low pressures, for example, 13 bar or even less.

However, the same pressures which are used to drive the piston 5 can be used to drive the pilot valve 18.

The valve element 9 can be located in the same bore which forms the low pressure chamber 3. It can have the same outer diameter (apart from the flange 10) as the piston 9 so that machining of the housing 2 is facilitated.

Figure 2:
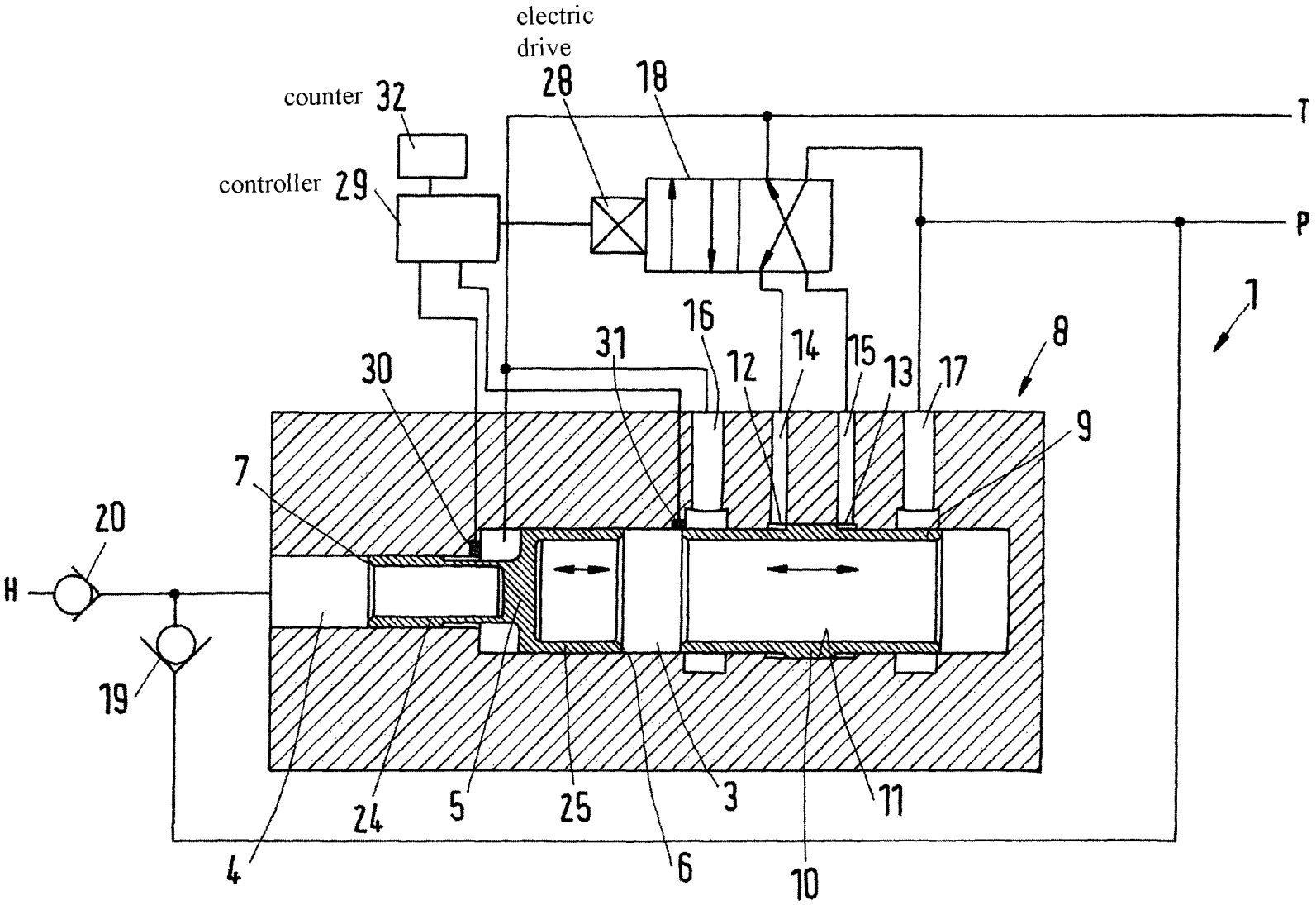
FIG. 2 is a schematic view of a slightly modified embodiment of a pressure intensifier.

FIG. 2 shows a slightly modified embodiment of a hydraulic pressure intensifier 1. The same reference numerals are used for the same elements as in FIG. 1.

In this embodiment the pilot valve 18 is not hydraulically driven, as in the embodiment shown in FIG. 1. However, the pilot valve 18 comprises an electric drive 28, for example, a solenoid.

The electric drive 28 is connected to a controller 29. The controller 29 controls the operation of the electric drive 28 and therefore the position of the pilot valve 18.

A first sensor 30 is connected to the controller 29. The first sensor 30 detects the end of the working stroke of the piston 5, i.e. the end of the movement of the piston 5 in which the volume of the high pressure chamber 4 is decreased. Furthermore, a second sensor 31 is provided detecting the other end position of the piston 5, i.e. the position of the movement of the piston 5 towards the valve element 9.

The controller 29 is connected to a counter 32. The counter 32 makes it possible, for example, to control the amount of fluid coming out of the high pressure port H of the pressure intensifier 1. When, for example, one knows the amount of fluid for one stroke out of the high pressure output H then it is possible, for example, to say that "I want 10 liters" out and then the controller 29 will control the pressure intensifier 1 accordingly.

By making it possible to control the amount of fluid delivered from the pressure intensifier 1 it is possible, for example, to synchronize two or more pressure intensifiers. This could, for example, be in connection with some kind of load controlled by a couple of piston-cylinder-arrangements, each having an integrated pressure intensifier, and thus making it possible to keep the load horizontal or in another predetermined orientation. This can be done without any form of feedback from a position sensor or something similar.

Both embodiments show a single acting pressure intensifier 1. However, it is clear that the principle shown with a pilot valve can also be used in connection with a double acting intensifier.

Further modifications of the embodiment shown are possible. When, for example, the pressure intensifiers 1 including the pilot valve 18 are built into a piston-cylinder-arrangement, it is beneficial to have a hydraulic control signal to control the pilot valve 18. The hydraulic signal can, for example, be generated from a magnetically controlled valve.

If it is possible to ensure that the stepped piston 5 reaches its end position each time one could control the construction shown in FIG. 2 without having the two sensors 30, 31. In this case, the pilot valve 18 can be switched, for example, controlled by time and then the number of cycles can be counted.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic pressure intensifier comprising a housing having a low pressure chamber and a high pressure chamber, force transmitting means between the low pressure chamber and the high pressure chamber, and a switching valve connecting the low pressure chamber to a first pressure or to a second pressure different from the first pressure, wherein the switching valve is controlled by a pilot valve, wherein the switching valve comprises a valve element having a first control pressure area and a second control pressure area, wherein the pilot valve controls a pressure difference between the first control pressure area and the second control pressure area, wherein the valve element comprises a flange extending radially, wherein the control pressure areas are located on opposite faces of the flange, and wherein the valve element in a first position connects the low pressure chamber to the first pressure and not to the second pressure, and in a second position connects the low pressure chamber to the second pressure and not to the first pressure.

2. The pressure intensifier according to claim 1, wherein the valve element is located in the low pressure chamber.

3. The pressure intensifier according to claim 2, wherein the valve element comprises an outer diameter that is equal to an outer diameter of a low pressure portion of the force transmitting means.

4. The pressure intensifier according to claim 2, wherein the housing comprises control channels for supplying pilot pressure to the control pressure areas and supply channels for supplying pressure to the low pressure chamber, wherein the control channels have a smaller cross sectional area than the supply channels.

5. The pressure intensifier according to claim 2, wherein the pressures acting on the control pressure areas are switched by the pilot valve between the first pressure and the second pressure.

6. The pressure intensifier according to claim 1, wherein the valve element comprises an outer diameter that is equal to an outer diameter of a low pressure portion of the force transmitting means.

7. The pressure intensifier according to claim 6, wherein the housing comprises control channels for supplying pilot pressure to the control pressure areas and supply channels for supplying pressure to the low pressure chamber, wherein the control channels have a smaller cross sectional area than the supply channels.

8. The pressure intensifier according to claim 1, wherein the housing comprises control channels for supplying pilot pressure to the control pressure areas and supply channels for supplying pressure to the low pressure chamber, wherein the control channels have a smaller cross sectional area than the supply channels.

9. The pressure intensifier according to claim 1, wherein the pressures acting on the control pressure areas are switched by the pilot valve between the first pressure and the second pressure.

10. The pressure intensifier according to claim 1, wherein the pilot valve is controlled by the force transmitting means.

11. The pressure intensifier according to claim 1, wherein the pilot valve is pressure controlled.

12. The pressure intensifier according to claim 1, wherein the pilot valve is electrically controlled.

13. The pressure intensifier according to claim 12, wherein the pilot valve is connected to a controller, wherein the controller comprises a counter counting strokes of the pilot valve and/or of the switching valve.

14. The pressure intensifier according to claim 13, wherein the pressure intensifier is part of a piston-cylinder-arrangement.

15. The pressure intensifier according to claim 1, wherein the valve element is located in a bore of the housing.

16. The pressure intensifier according to claim 15, wherein the flange extends into a groove of the housing, and wherein an inner diameter of the groove is larger than an inner diameter of the bore.

17. The pressure intensifier according to claim 15, wherein the flange extends into a groove of the housing, and wherein an inner diameter of the groove is larger than an inner diameter of the low pressure chamber.

18. The pressure intensifier according to claim 1, wherein the flange is arranged at an intermediate portion of the valve element.

19. The pressure intensifier according to claim 1, wherein the valve element defines a valve element bore extending axially through the valve element.

20. A hydraulic pressure intensifier comprising a housing having a low pressure chamber and a high pressure chamber, force transmitting means between the low pressure chamber and the high pressure chamber, and a switching valve connecting the low pressure chamber to a first pressure or to a second pressure different from the first pressure, wherein the switching valve is controlled by a pilot valve, wherein the switching valve comprises a valve element having a first control pressure area and a second control pressure area, wherein the pilot valve controls a pressure difference between the first control pressure area and the second control pressure area, wherein the housing comprises control channels for supplying pilot pressure to the control pressure areas and supply channels for supplying pressure to the low pressure chamber, wherein the control channels have a smaller cross sectional area than the supply channels.

21. A hydraulic pressure intensifier comprising a housing having a low pressure chamber and a high pressure chamber, a piston extending between the low pressure chamber and the high pressure chamber, and a switching valve connecting the low pressure chamber to a first pressure or to a second pressure different from the first pressure, wherein the switching valve is controlled by a pilot valve, wherein the switching valve comprises a valve element having a first control pressure area and a second control pressure area, wherein the pilot valve controls a pressure difference between the first control pressure area and the second control pressure area, wherein the housing comprises control channels for supplying pilot pressure to the control pressure areas and supply channels for supplying pressure to the low pressure chamber, and wherein hydraulic pressure in the low pressure chamber acts directly on the piston to drive the piston, and wherein the valve element does not contact the piston.

* * * * *